United States Patent [19]

Neubert

[11] Patent Number: 4,961,685

[45] Date of Patent: Oct. 9, 1990

[54] PROTECTION RING OF FIBER MATERIAL FOR CONTAINING FRAGMENTS OF BURSTING STRUCTURAL COMPONENTS

[75] Inventor: Horst Neubert, Unterhaching, Fed. Rep. of Germany

[73] Assignee: MTU-Motoren-und Turbinen-Union Muenchen GmbH, Munich, Fed. Rep. of Germany

[21] Appl. No.: 402,053

[22] Filed: Sep. 1, 1989

[30] Foreign Application Priority Data

Sep. 6, 1988 [DE] Fed. Rep. of Germany ..... 3830232

[51] Int. Cl.[5] ..... F01D 25/24

[52] U.S. Cl. ..... 415/197; 415/9; 415/119

[58] Field of Search ..... 415/9, 119, 126, 128, 415/182.1, 196, 197, 200; 29/156.8 R

[56] References Cited

U.S. PATENT DOCUMENTS

| | | | |
|---|---|---|---|
| 3,602,602 | 8/1971 | Motta | 415/9 |
| 3,978,256 | 8/1976 | James | 428/66 |
| 4,452,563 | 6/1984 | Belanger et al. | 415/119 |
| 4,699,567 | 10/1987 | Stewart | 415/9 |
| 4,705,454 | 11/1987 | Bouiller et al. | 415/9 |
| 4,878,821 | 11/1989 | Huether et al. | 415/9 |
| 4,902,201 | 2/1990 | Neubert | 415/197 |

FOREIGN PATENT DOCUMENTS 2950752 6/1980 Fed. Rep. of Germany .

*Primary Examiner*—Edward K. Look
*Assistant Examiner*—Hoang Nguyen
*Attorney, Agent, or Firm*—W. G. Fasse; D. H. Kane, Jr.

[57] ABSTRACT

A protection ring of fiber material is constructed for containing or stopping fragments of a bursting structural component passing through a housing, such as a gas turbine housing through which a rotor blade fragment has burst by centrifugal force. Retaining pins are distributed around the housing zone to be protected. The fiber strands are looped around the retaining pins to form a fiber netting without any matrix material. Friction between fibers and pins is kept low so that the fibers can stretch along substantially their entire length for taking up impact energy. Thus, substantially the entire volume of the ring can participate in taking up impact energy and not only a localized ring portion that received an impact. A desirable lightweight structure is achieved.

16 Claims, 2 Drawing Sheets

PROTECTION RING OF FIBER MATERIAL FOR CONTAINING FRAGMENTS OF BURSTING STRUCTURAL COMPONENTS

FIELD OF THE INVENTION

The invention relates to a protection ring made of fiber material for containing fragments of bursting structural components such as fragments of a rotor blade in a turbine engine. Fragments of this type have a tendency to penetrate with a high kinetic energy through a housing, for example, a turbine housing containing in its inner space a rotor and a stator.

BACKGROUND INFORMATION

German Patent Publication No. (DE-OS) 2,950,752 discloses a bursting protection ring in which several layers of fiber materials are wound onto a housing. In order to achieve a high utilization of the elastic characteristics of the fibers for the containment of fragments, the fiber material used contains very little resin matrix material or even none at all. As a result, the fiber material retains its elasticity, whereby it can stretch in response to an impact by a bursting fragment so that the entire kinetic energy can be taken up. However, the known structure has the disadvantage that only that portion of the fiber material zone participates more or less in the energy conversion that was directly exposed to the impact of the fragment. Fibers not directly exposed to the impact only participate minimally in the energy conversion. As a result, a substantial number of fiber layers is required for achieving a high containing efficiency. Such multitude of fiber layers are wound one on top of the other, whereby the containment ring has a substantial weight.

OBJECTS OF THE INVENTION

In view of the foregoing it is the aim of the invention to achieve the following objects singly or in combination:

- to construct a protection ring of fiber material for containing fragments in such a way that the participation of the individual fiber strands in the energy conversion is increased compared to the prior art so that almost all fiber strands of a containment ring according to the invention will participate in the energy conversion substantially independently of the impact location;
- to wind the fibers substantially without any matrix material and in such a manner that the weight of the containment ring is substantially reduced as compared to the prior art; and
- to wind the fibers of the containment ring in such a manner that each fiber strand is uniformly loaded along its entire length by a localized impact.

SUMMARY OF THE INVENTION

A protection ring of fiber material for containing fragments of bursting structural components is characterized in that the fibers are wound onto retaining pin means arranged circumferentially around the zone of a structural component to be protected. The fiber strands loop, at least partially, around the retaining pins which may extend in radial rows of retaining pins or which may form a cage with axially extending pins around the component to be protected. In both embodiments the fibers form a grid type fiber net between the retaining pins. Preferably, the pins carry rollers around which the fiber strands loop for reducing friction between the fibers and the retaining pins to permit the yielding movement of the fiber netting in response to the impact of a fragment.

The protection ring according to the invention has the advantage that upon impact of centrifugally travelling fragments, for example, a blade fragment in a gas turbine, the fiber strands are capable to stretch along their entire length which zig-zags around the gas turbine housing in the zone to be protected. This stretching along the entire length is important for the conversion of energy and the stretching no longer depends on the location of the impact around the circumference of the protected housing. By enabling the fiber strands to loop around the retaining pins with as little friction as possible, the stretching is even facilitated so that the fiber strands are loaded around the entire circumference of the protection ring in a uniform load distribution with only a load peak at the point of impact. Due to the zig-zag deployment of the fiber strands, they have a substantial total length, thereby increasing substantially the energy that can be taken up by each fiber strand as compared to conventional structures of this type. According to the invention the entire fiber structure, or rather all the fibers of the fiber material in the entire ring volume of the protection ring are participating in the energy conversion, whereby the quantity of fiber material may be reduced and hence the weight of the protection rings according to the invention also becomes smaller as compared to the prior art.

In one advantageous embodiment of the invention the fiber strands loop around the radial retaining pins that are anchored axially outside the fiber netting relative to the longitudinal axis of the housing portion to be protected. Such an arrangement of the retaining pins makes it possible to efficiently introduce the forces effective on the retaining pins into the housing by locating the fixing points for the retaining pins outside the axial length of the housing portion to be protected. Thus, it is possible to make the axial width or length of the protection ring substantially independent of the structural conditions that must be met for securing the retaining pins, whereby the axial width of the protecting ring can be made slightly larger than the axial length of the housing portion to be protected.

According to another advantageous embodiment the retaining pins are arranged axially and hence extend in parallel to the longitudinal housing axis. In such an embodiment both ends of each retaining pin are mounted in respective radially extending housing flanges.

Whether the retaining pins extend axially or radially, they may be mounted to radially extending housing flanges or in stiff rings secured to the housing. Such flanges or rings facilitate a simple mounting of the protection ring to the housing, whereby the reaction forces introduced into the retaining pins are in turn introduced into the housing either through the flanges or through the stiff rings welded or screwed to the housing.

In certain instances it may be preferable to use radially extending retaining pins since this makes it possible to use a large number of retaining pins distributed along the circumference of the housing to be protected, thereby permitting the formation of a densely knotted fiber network.

According to another embodiment of the invention rotatable rollers are supported on the retaining pins which extend as radial shafts for the rotating rollers. This feature of the invention substantially reduces in an advantageous manner the friction between the fiber strands and the retaining pins looping around the friction reducing rollers. As a result, the distribution of any impact load uniformly along the entire length of the individual fiber strands is facilitated.

As mentioned, the fibers are wound onto the retaining pins or rollers in such a manner that the fibers form a zig-zag configuration when the pins extend radially, whereby the angle between two fiber strand legs meeting at a retaining pin should be within the range of about 60° to about 120°. When the retaining pins extend axially, the fiber strands will form polygonal configurations around the housing portion to be protected. The angle between two fiber strand legs forming neighboring sides of the polygon may be within the range of about 90° to about 150°. The size of the just mentioned angles depends on the forces to be taken up by the retaining pins and by the stress that can be taken up by the particular types of fibers used. The higher the forces to be taken up, the smaller should be the angles because that will result in a denser distribution of the fibers if the retaining pins extend radially. On the other hand, a denser packing closer to the surface of the housing section to be protected may be achieved with larger looping angles between fiber strands passing around axially extending retaining pins. Where the retaining pins extend radially, the fiber packing becomes denser for smaller looping angles. The size of the looping angle will also depend on the desired spacing between the inner surface of the retaining ring and the outer surface of the housing section to be protected.

In all embodiments it is desirable to interconnect the individual fiber or fiber strands where they intersect with each other. Such connection can be accomplished by knotting or by adhesively bonding the fibers to each other at the intersections to form interconnected crossing junctions. Such an interconnection between plied fiber strands or layers prevents fragments from passing through between individual fiber strands forming the netting. Such interconnecting crossing junctions reduce the mesh size and also the total number of fibers needed to form an effective protection ring.

BRIEF DESCRIPTION OF THE DRAWINGS

In order that the invention may be clearly understood, it will now be described, by way of example, with reference to the accompanying drawings, wherein.

DETAILED DESCRIPTION OF PREFERRED EXAMPLE EMBODIMENTS AND OF THE BEST MODE OF THE INVENTION

Figure 1:
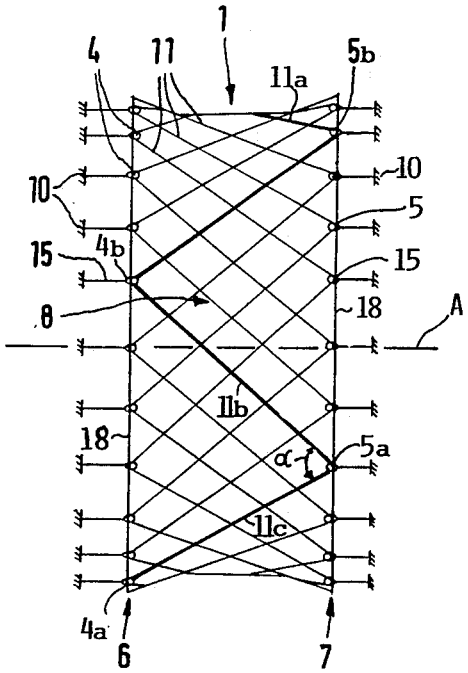
FIG. 1 is a schematic side view or projection of one embodiment of a protection ring according to the invention with radially extending retaining pins.

Referring to FIG. 1, the protection ring 1 according to the invention is constructed as a multi-layer fiber strand netting 8. The fiber netting 8 comprises a plurality of fiber strands 11 made of aramid or glass fibers. The fiber strands 11 are looped around fiber retaining pins 4 and 5. The pins 4 form a first group 6 of fiber retaining pins extending around a housing portion 18. The pins 4, 5 extend substantially radially relative to a longitudinal housing axis A. The pins 4 are rigidly secured to fixed points 10 as will be described in more detail below with reference to FIG. 2. The pins 5 form a second group 7 of fiber retaining pins also connected to fixed points 10 of the housing portion 18.

A particular fiber strand **11*a* is highlighted in FIG. 1 by a heavy line to show how the fiber strands loop around the pins 4, 5. More specifically, the strand 11*a* loops around pins 4*a* and 4*b* on the left side of the housing portion to be protected and around pins 5*a* and 5*b* on the right side of the housing portion. The strand 11*a* has strand legs 11*b* and 11*c* enclosing an angle for example shown at the pin 5*a*. The angle $\alpha$ is within the range of about 60° to about 150°, preferably within the range of about 90° to about 120°. The size of the angle $\alpha$ will be selected in accordance with the desired density of the netting 8. Additionally, the angle $\alpha$ will depend on the axial length of the housing portion 18 to be protected and on the number of pins skipped between pins around which the fiber strand 11*a* loops. In FIG. 1, for example, five pins are skipped between the pins 4*a* and 4*b* and also between the pins 5*a* and 5*b* by the fiber strand 11*a*. Other fiber strands of the netting loop around these pins around which the fiber strand 11*a*** does not loop. As shown, the strands follow a zig-zag course around the housing portion to be protected. Many strands may loop around each pin.

Figure 2:
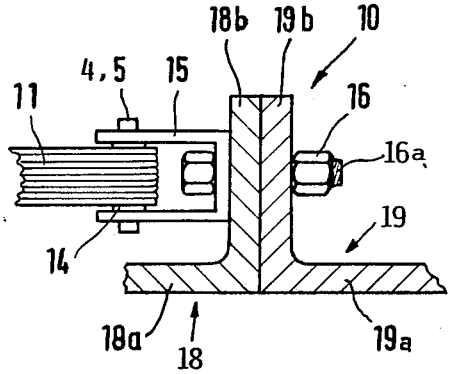
FIG. 2 shows on an enlarged scale the type of mounting of the retaining pins as used in FIG. 1.

FIG. 2 shows one possible example of mounting means for securing the retaining pins 4 and 5 to the housing portion 18 to be protected. The housing portion 18 has a wall, for example, a cylindrical wall **18*a* and flanges 18*b*. The pin mounting means comprise a fork-type member 15 having two arms with free ends to which the pins 4, 5 are mounted. Preferably, the pins carry a rotatable roller 14 around which a plurality of fiber strands 11 are looped. The roller 14 reduces the friction between the strands 11 and the pins 4, 5 so that a fiber strand can more easily stretch along its entire length in response to a localized impact by a fragment. The housing portion 18 is secured to a housing section 19 also having a wall 19*a* and a flange 19*b*. The two flanges 18*b* and 19*b* are connected to each other by screw bolts 16*a* and nuts 16. These bolts and nuts simultaneously connect the forked, U-shaped mounting members 15 to the housing flanges. The orientation of the members 15 is such that the pins 4, 5 extend substantially radially. However, it is also possible to let the pins 4, 5 extend tangentially to a circle concentrically surrounding the housing portion 18*a*. Such orientation is simply accomplished by properly adjusting the forks 15 when the nuts and bolts 16, 16*a*** are loosened. Or the pins are tilted in the direction indicated by a dashed line.

Figure 3:
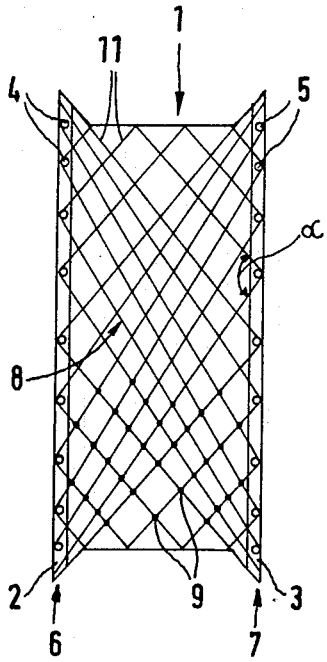
FIG. 3 illustrates a view similar to that of FIG. 1, with also radially extending retaining pins mounted in initially separate pin rings.

FIG. 3 illustrates a modification of the mounting means for the retaining and looping pins 4 and 5. In this embodiment two stiff pin mounting rings 2 and 3 are used for securing the pins to the housing, preferably in locations outside the housing portion to be protected. The ring 2 carries the group 6 of pins 4. The ring 3 carries the group 7 of pins 5. The rings 2, 3 are provided with substantially radially extending holes in which the pins 4, 5 are received and held in place, for example, by welding, soldering, or brazing. The rings 2, 3 may be separate rings or they may also be provided in the form of housing flanges. The separate rings may be welded to the housing.

FIG. 3 further shows that crossing points 9 between individual fiber strands 11 form interconnected crossing junctions. The interconnection may be accomplished by knots, by adhesive, by heat welding, and similar connection methods. The interconnected crossing junctions thus determine the mesh size and prevent a fragment from passing through an open mesh.

Figure 4:
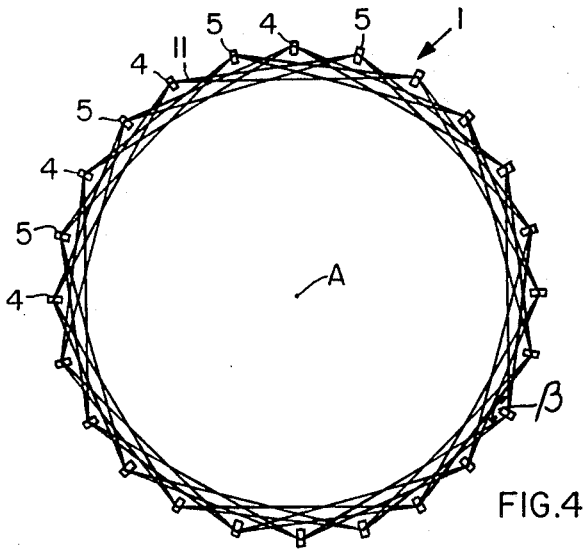
FIG. 4 shows a schematic axial view of the fiber netting.
Figure 5:
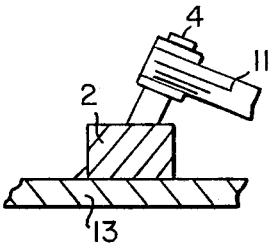
FIG. 5 shows an enlarged side view of a retaining pin.

FIG. 4 illustrates the fiber netting and the retaining pins 4 and 5 of the two rows of pins according to FIG. 1. Each pin 4 and 5 is mounted in a respective flange or ring 2, 3 as shown in FIG. 1. As can be seen the fiber strands looping around pins 4 and 5 also form an angle $\beta$ in a plane normal to the axis A. Therefore it is advantageous to tilt the pins 4 and 5 as shown with a pin 4 in FIG. 5. The tilt angle to the radial direction is in a plane defined by the axial direction A and a corresponding radial direction. The angle should be chosen according to the values of angle $\alpha$ (FIG. 1) and angle $\beta$ (FIG. 4) as these two angles are only projections of the real angle in two view directions. The pins 4 and 5 will preferably be uniformly distributed around the circumference of the housing.

Figure 6:
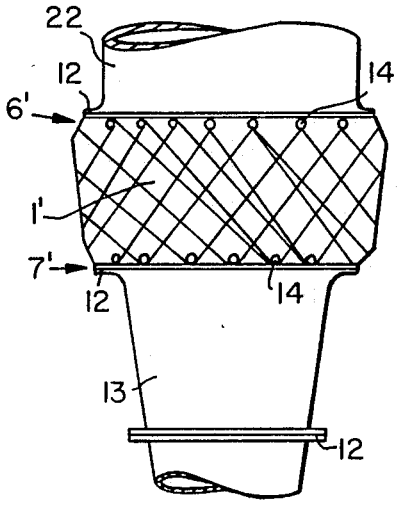
FIG. 6 is a side view of another embodiment with radially extending retaining pins for forming a protection ring having substantially a conical configuration.

FIG. 6 illustrates a conical protection ring 1' bridging a housing portion between a cylindrical housing section 22 and a conical housing section 13. The housing sections or portions are interconnected by flanges 12. The flanges carry looping rollers 14 as discussed above. However, looping pins may be used. A group 6' of looping rollers 14 is provided at the large end diameter of the protection ring 1'. A second group 7' of looping rollers 14 is provided at the small end diameter of the protection ring 1'. The number of looping rollers 14 in the group 7' at the smaller diameter may be smaller than the number of looping rollers in the group 6'. Alternatively, the circumferential spacing between the looping rollers in the group 7' may be smaller than that in the group 6'. Thus, the density of the fiber netting may increase toward the smaller diameter end of the protection ring 1'. This may be a desirable feature, especially if components that can burst are located near the smaller diameter end.

Although the invention has been described with reference to specific example embodiments, it will be appreciated, that it is intended to cover all modifications and equivalents within the scope of the appended claims.

What I claim is:

1. A protection ring structure of fiber material for containing fragments of a bursting structural component passing through a housing defining a longitudinal axis, comprising a plurality of fiber retaining pins, means mounting said fiber retaining pins to said housing in such positions that said pins encircle said housing, and fiber strands looping at least partially around said retaining pins for forming a fiber strand netting all around a zone of said housing to be protected.

2. The protection ring structure of claim 1, wherein said retaining pins comprise two groups of pins arranged with an axial spacing from each other around said housing.

3. The protection ring structure of claim 2, wherein said mounting means comprise a fork (15) for holding each retaining pin, said housing having flanges, said mounting means further comprising means for securing said forks to said flanges.

4. The protection ring structure of claim 3, wherein said forks are so oriented that all pins in each group extend substantially radially relative to said longitudinal axis.

5. The protection ring structure of claim 3, wherein said securing means comprise bolts extending substantially in parallel to said longitudinal axis and axially outside an axial length of said housing zone to be protected and thus outside an axial length of said fiber strand netting.

6. The protection ring structure of claim 3, wherein said fork has two arms each with a free end, said retaining pins being mounted to said free arm ends.

7. The protection ring structure of claim 6, wherein said pins comprise rollers, said fiber strands looping at least partially around said rollers for reducing friction between said fiber strands and said rollers.

8. The protection ring structure of claim 1, wherein said mounting means comprise two stiff rings rigidly attached to said housing, said retaining pins being secured to said stiff rings.

9. The protection ring structure of claim 1, wherein said fiber strands have strand legs including a strand leg leading to a particular retaining pin and a strand leg leading away from said particular retaining pin, said strand legs enclosing an angle ($\alpha$) within the range of about 60° to about 150°.

10. The protection ring structure of claim 9, wherein said angle ($\alpha$) is within the range of about 90° to about 120°.

11. The protection ring structure of claim 1, wherein crossing points between neighboring fiber strands are interconnected to form interconnected crossing junctions.

12. The protection ring structure of claim 11, wherein said interconnected crossing junctions comprise knots between said neighboring fiber strands.

13. The protection ring structure of claim 11, wherein said interconnected crossing junctions comprise adhesive bonds between said neighboring fiber strands.

14. The protection ring structure of claim 1, wherein said retaining pins are tilted from the radial direction in the direction of said longitudinal axis.

15. The protection ring structure of claim 14, wherein said mounting means comprise two housing flanges or rings, and wherein said retaining pins are mounted with each end in one of said flanges or rings.

16. The protection ring of claim 1, wherein said retaining pins extend substantially tangentially to a circle concentric to said longitudinal axis around said housing.

* * * * *